US011043758B2

(12) United States Patent
Hofmann et al.

(10) Patent No.: US 11,043,758 B2
(45) Date of Patent: Jun. 22, 2021

(54) BUSHING ADAPTER AND BUSHING WITH SUPERIOR MECHANICAL CHARACTERISTICS

(71) Applicants: Tyco Electronics Raychem GmbH, Ottobrunn (DE); Carrier Kheops BAC, Allonnes (FR); Tyco Electronics UK Ltd, Swindon (GB)

(72) Inventors: Martin Hofmann, Assling (DE); Hervé Cheron, Le Mans (FR); Torsten Friedrich, Martinsried (DE); Yves Cadoret, Le Mans (FR); Laurence Mortimer, Gloucester (GB)

(73) Assignees: Tyco Electronics Kaycnem GmbH, Ottobrunn (DE); Carrier Kheops BAC, Allonnes (FR); Tyco Electronics UK Ltd, Swindon (GB)

( * ) Notice: Subject to any disclaimer, the term of this patent is extended or adjusted under 35 U.S.C. 154(b) by 55 days.

(21) Appl. No.: 16/524,675

(22) Filed: Jul. 29, 2019

(65) Prior Publication Data

US 2019/0348772 A1 Nov. 14, 2019

Related U.S. Application Data

(63) Continuation of application No. PCT/EP2018/052398, filed on Jan. 31, 2018.

(30) Foreign Application Priority Data

Jan. 31, 2017 (EP) ..... 17305104

(51) Int. Cl.

| | |
|---|---|
| ***H01R 4/56*** | (2006.01) |
| ***H01R 4/30*** | (2006.01) |
| *H01R 13/53* | (2006.01) |

(52) U.S. Cl.

CPC ..... *H01R 4/305* (2013.01); *H01R 4/301* (2013.01); *H01R 4/56* (2013.01); *H01R 13/53* (2013.01)

(58) Field of Classification Search

CPC ..... H01R 13/53; Y10S 439/921; Y10S 4/305; Y10S 4/301; Y10S 4/56

See application file for complete search history.

(56) References Cited

U.S. PATENT DOCUMENTS 4,202,591 A * 5/1980 Borgstrom ..... H02B 13/075 439/185
4,354,721 A * 10/1982 Luzzi ..... H01R 13/53 439/306

(Continued)

FOREIGN PATENT DOCUMENTS

CN 203839525 U 9/2014
CN 204481277 U 7/2015

(Continued)

OTHER PUBLICATIONS

PCT Notification, The International Search Report and the Written Opinion of the International Searching Authority, Intl App. No. PCT/EP2018/052398, dated Mar. 13, 2018, 15 pages.

(Continued)

*Primary Examiner* — Tho D Ta
(74) *Attorney, Agent, or Firm* — Barley Snyder

(57) ABSTRACT

A bushing adapter comprises an insert having a bore extending through the insert along a length direction of the insert and a fastening member extending through the bore. The insert is configured to be attached to a bushing conductor of a bushing. The fastening member has an operating portion positioned outside of the bore at a bushing internal end of the (Continued)

fastening member and a fastening portion positioned outside of the bore at a bushing external end of the fastening member.

20 Claims, 4 Drawing Sheets

(56) References Cited

U.S. PATENT DOCUMENTS

| | | | | |
|---|---|---|---|---|
| 5,816,835 | A | 10/1998 | Meszaros | |
| 8,328,569 | B2 * | 12/2012 | Roscizewski | H01R 13/53 439/187 |
| 9,325,104 | B2 * | 4/2016 | Siebens | H01R 43/18 |

FOREIGN PATENT DOCUMENTS

| | | | |
|---|---|---|---|
| DE | 19917407 | C1 | 12/2000 |
| EP | 2806510 | A2 | 11/2014 |
| EP | 2806510 | A3 | 12/2014 |
| JP | S58201278 | A | 11/1983 |
| JP | 2016144305 | | 8/2016 |

OTHER PUBLICATIONS

Chinese Office Action and English translation, dated Jun. 2, 2020, 19 pages.
Abstract of DE 19917407, dated Dec. 14, 2000, 1 page.
Abstract of CN 204481277, dated Jul. 15, 2015, 2 pages.
Abstract of CN 203839525, dated Sep. 17, 2014, 1 page.
Abstract of JP 2016-144305 dated Aug. 8, 2016, 1 p.
1st Office Action from Japanese Patent Office dated Sep. 8, 2020 and English translation thereof. 10 pp.
Office Action from the KIPO dated Oct. 5, 2020 and English translation thereof. 12 pp.

* cited by examiner

BUSHING ADAPTER AND BUSHING WITH SUPERIOR MECHANICAL CHARACTERISTICS

CROSS-REFERENCE TO RELATED APPLICATIONS

This application is a continuation of PCT International Application No. PCT/EP2018/052398, filed on Jan. 31, 2018, which claims priority under 35 U.S.C. § 119 to European Patent Application No. 17305104.6, filed on Jan. 31, 2017.

FIELD OF THE INVENTION

The present invention relates to a bushing and, more particularly, to a bushing for connecting an external cable and an internal conductor of a housing.

BACKGROUND

In many technical fields electrical power has to be supplied by or to certain components, such as sophisticated switches, transformers, motors, and the like, which may frequently be positioned, at least partially, in an appropriate housing. On the other hand, outside the housing the required electrical power may be supplied by or to one or more appropriately dimensioned cables connected to a respective power supply or electric component. The electrical power may be provided as AC or DC or both. Depending on the application, the respective electrical power may range from several tens of kilowatts to several hundred of kilowatts and even higher, thereby requiring respective cable configurations in terms of cross-section and insulation characteristics. For example, high electrical power may frequently be provided in the context of medium voltages to high voltages, ranging from several hundred volts to several thousand volts, thereby resulting in relatively low currents to be conveyed in the external cables. In other applications, relatively low voltages may be used, for instance in mobile DC applications, such as electric vehicles, thereby imposing superior requirements with respect on the drive current capability of the respective cables.

The corresponding external cables may require an appropriate configuration with respect to conductor material, conductor cross-section, insulating sheath, and the like, thereby typically resulting in a cable configuration including one or more copper-based or aluminum-based core wires with a cross-section of several centimeters surrounded by an appropriate sheath or cover material that provides for the required insulating behavior and integrity of the entire cable. These cables may frequently be exposed to relatively harsh environments, for instance such cables may be exposed to outside conditions including exposure to direct sunlight, extreme temperatures ranging from −50° C. to 70° C., and the like, thereby necessitating the usage of appropriate sheath materials, which may therefore also contribute, in addition to the core material, to additional weight of the respective cables.

Power receiving components or power supplying components, such as switches, transformers, motors, and the like are often encapsulated in an appropriate housing so as to provide for superior integrity of such components or at least of any contact structures thereof. Due to the protected interior of the housing, any requirements for housing-internal conductors may be significantly less stringent, thereby even allowing the usage of such housing-internal conductors without external insulating material, and the like. One critical interface of a housing-internal conductor and an external cable is a respective bushing, which is to be understood as a component that is appropriately mounted to the housing and provides a passage for the exchange of electrical power between the external cable and the housing.

A corresponding bushing typically comprises a highly conductive metal conductor, typically in the form of a copper bolt, which is surrounded by an insulating material that is formed from an appropriate material, such as epoxy resin. Epoxy resin is known to exhibit high mechanical strength and stiffness and superior insulating characteristics. In order to provide a mechanically and electrically stable bushing, the metal core and the epoxy resin are typically formed into an integral component by, for instance, injection molding, thereby obtaining a robust and stiff product. Consequently, by providing an appropriate mounting flange at any appropriate position the bushing may be inserted into a corresponding bore provided in the housing and may be fixed thereto by the mounting flange, providing for high mechanical and electrical integrity of the resulting connection between an external cable attached to the bushing at one end thereof and a housing-internal conductor connected to the bushing at the other end thereof.

These well-established high-power bushings, however, may suffer from increased failure events when used in applications associated with harsh external conditions. For example, the robust and stiff configuration of the conventional high-power bushing may exhibit an increasing number of device failures upon being exposed to relatively extreme temperatures, for instance ranging from approximately −50° C. to approximately 70° C., as are typically encountered under various environmental conditions in various geographic locations. For instance, power supply in many types of vehicles, such as trains, may result in exposure to harsh conditions, such as the above-referenced temperatures, for instance upon direct exposure to sunlight, while in cold winter days extremely low temperatures may occur. Such extreme temperatures may by itself represent a significant stress for the bushing, as typically epoxy resin and the usually highly conductive copper material may have very different coefficients of thermal expansion, which may result in cracks or any other damage in the insulating epoxy resin, in particular, when certain mechanical forces may additionally act on certain bushing components.

As an example, the external cable, which may have a relatively high weight, is typically connected to the bushing so that an end face of the copper bolt of the bushing is in firm contact with a respective end face of the external cable or in most cases with a contact assembly connected thereto, which may result in a more or less pronounced bending force exerted on the copper bolt of the bushing. Under extreme temperature conditions, as discussed above, however, these relatively high bending forces may promote the creation of damage in the insulating material, since the difference in the thermal expansion in combination with the additional mechanical forces acting the copper bolt and hence on the epoxy resin may finally result in a breakage of the external sheath, thereby also typically resulting in a failure of the entire high-power connection. Similarly, at moderately high temperatures the mechanical properties of the epoxy resin may also be subjected to degradation, thereby also increasing the probability of resulting in a severe device failure.

The situation described above may even become worse in circumstances, in which the respective forces acting on certain components of the bushing may vary timely and spatially, for instance, when externally or internally induced vibrations are present. The source of such vibrations may be, for instance, in mobile applications the movement along respective railroad rails, wherein the joints between adjacent rails may cause significant vibrations in a more or less regular manner, depending on the overall speed of the respective electric vehicle and the distance of the joints. Similar vibrations, however, with reduced regularity, may be encountered in street-bound vehicles, wherein speed and surface conditions of a respective road may significantly determine the resulting "spectrum" of vibrations acting on the corresponding bushing components.

Moreover, in train applications or similar use cases, sophisticated contactors or switching devices may have to be used, in which moderately high masses are accelerated and moved during a corresponding switching process, thereby typically involving a direct impact of the corresponding contact components and introducing respective mechanical vibrations into the bushing components. Although rare events of such induced vibrations may not necessarily significantly affect the bushing and the electrical and insulating state of the various components, over an extended lifetime, which is typically required in many applications, such as 10 to 15 years, the conventional robust and stiff configuration, for instance obtained on the basis of an integrally molded epoxy resin and copper bolt component may result in a significant reliability issue, thereby rendering the conventional configuration less than desirable for a high-power bushing to be used in harsh environmental conditions.

In view of the above described situation, a reliable mechanical connection between the housing-internal cable and the bushing is required. Furthermore, in addition to superior mechanical reliability, a corresponding connection may also have to provide for superior installation and maintenance performance, since typically the installation and regular and non-scheduled maintenance activities may significantly contribute to overall cost of ownership of such sophisticated electric installations. For example, in conventional bushings the connecting portion to be connected to the housing-internal conductor is typically obtained by providing a threaded recess in the conductor, which may be screwed onto the housing-internal conductor or any contact member connected thereto.

Consequently, upon installing or dissembling the connection between the housing-internal conductor and the bushing, a respective relative rotation between the conductor and the bushing has to be carried out, wherein typically the bushing is usually the component to be rotated. Therefore, a respective mechanical connection between the housing and the bushing has to be detached prior to actually dissembling the mechanical connection between the housing-internal conductor and the bushing. Similarly, after reinstalling the mechanical connection between the housing-internal conductor and the bushing, the bushing has to be fixed to the housing, which may typically require a new alignment procedure for appropriately connecting the housing and the bushing. Similarly, upon an initial installation of the bushing, a precise and permanent alignment and fixation of the bushing with respect to the housing may not be feasible as long as the mechanical connection between the housing-internal conductor and the bushing is not completed.

SUMMARY

A bushing adapter comprises an insert having a bore extending through the insert along a length direction of the insert and a fastening member extending through the bore. The insert is configured to be attached to a bushing conductor of a bushing. The fastening member has an operating portion positioned outside of the bore at a bushing internal end of the fastening member and a fastening portion positioned outside of the bore at a bushing external end of the fastening member.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
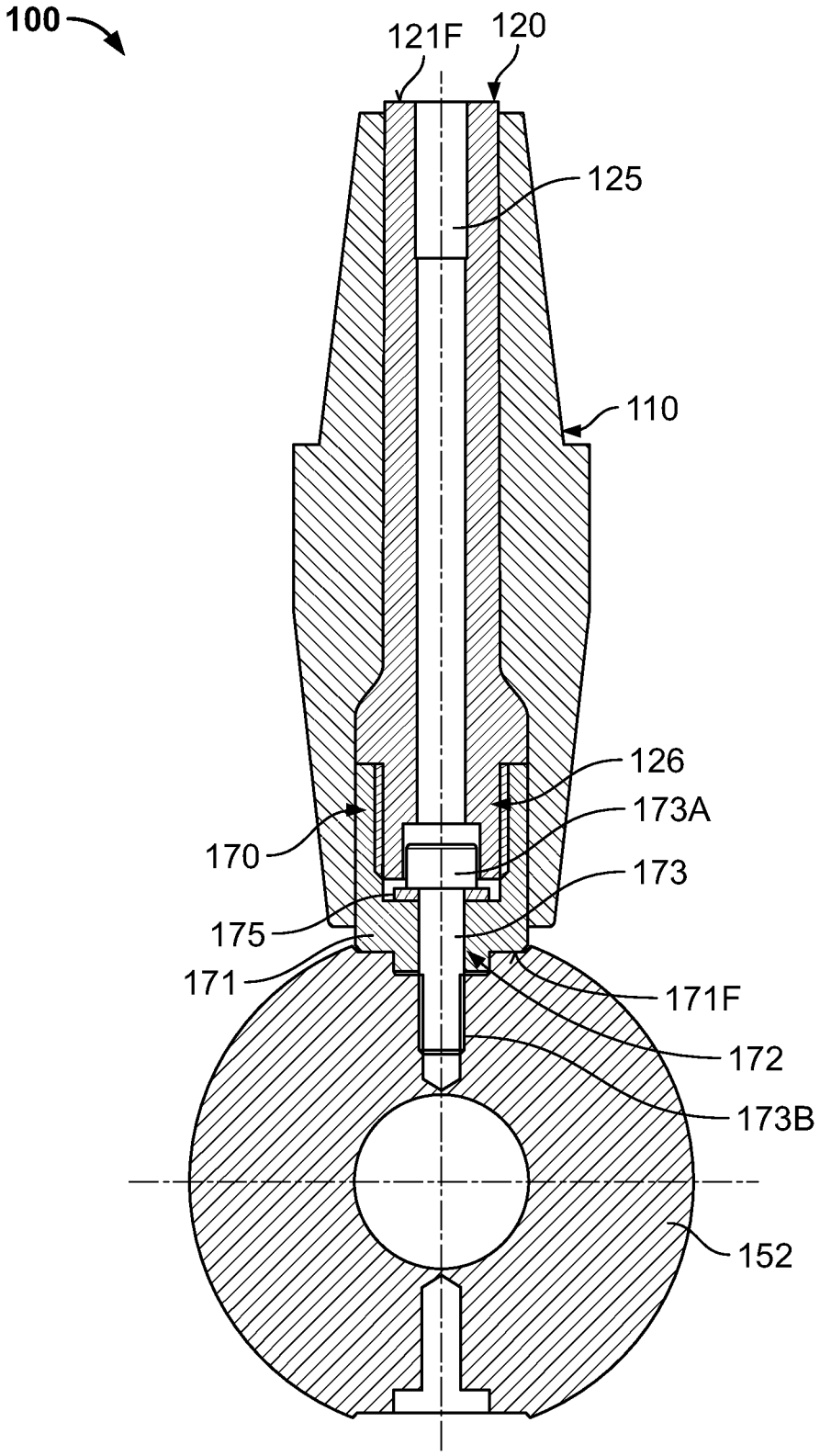
FIG. 1 is a sectional view of a bushing according to an embodiment connected to an external conductor.

Exemplary embodiments of the present invention will be described hereinafter in detail with reference to the attached drawings, wherein like reference numerals refer to like elements. The present invention may, however, be embodied in many different forms and should not be construed as being limited to the embodiments set forth herein. Rather, these embodiments are provided so that the present disclosure will convey the concept of the disclosure to those skilled in the art.

A bushing 100 according to an embodiment, as shown in FIG. 1, comprises a bushing conductor 120, a bushing adapter 170 that is attached to the bushing conductor 120, and an insulating body 110. In various embodiment, the insulating body 110 may be formed of any appropriate material, such as epoxy resin, possibly in combination with other materials, as will also be discussed later on. The insulating body 110 encloses the bushing conductor 120 and is in mechanical contact therewith so as to form a mechanically robust component of the bushing 100.

The bushing 100 and thus the bushing adapter 170 may be appropriately dimensioned and configured so as to be used for high power applications requiring the transfer of electrical power in the range of several tens of kilowatts to several hundred kilowatts and higher. For example, transferring such amounts of power may be required in mobile applications, such as electrically driven vehicles, such as trains, cars, vans, and the like, or in other stationary applications, such as transformers, electric motors or generally electric machines in the form of motors and/or generators, as for instance used in wind power stations, and the like. It should be appreciated that in other embodiments the respective dimensions of the bushing 100 may be reduced so as to comply with low-power applications requiring the transfer of electrical power in the range of few watts to several hundred watts.

The bushing 100 may be configured so as to connect to an external cable, such as via a contact or plug assembly, by connecting a corresponding end face 121F at a first end of the bushing 100 to a corresponding contact face of the external cable or the corresponding contact assembly connected therewith. A second end of the bushing 100 may be configured to be connected, electrically and mechanically, to an external conductor 152 or a corresponding contact assembly associated therewith, wherein the external conductor 152 may typically be provided within a specific housing, as will be explained later on in more detail. The mechanical connection to the external conductor 152 and the electrical connection may be established on the basis of the bushing adapter 170, as in the embodiment shown in FIG. 1, while in other embodiments, such as will be described below with reference to FIG. 2, the electrical connection may be established on the basis of the bushing conductor.

The bushing conductor 120, as shown in FIG. 1, includes a recess 126, which accommodates a part of the bushing adapter 170. The bushing adapter 170 comprises an insert 171, which is appropriately adapted in size and shape to the recess 126. In the embodiment shown, the insert 171 is formed so as to enclose the recessed portion of the bushing conductor 120, thereby completing the conductor 120 and providing one or more end faces 171F for electrically contacting the external conductor 152. The insert 171 may be attached to the conductor 120 in the recess 126 by any appropriate connecting technology, such as providing a threaded surface portion on the insert 171 and a complementary threaded surface portion on the recessed part of the conductor 120, which defines the recess 126. In other cases, the insert 171 may be attached to the conductor 120 by press fitting, pinning, gluing, soldering, welding, and the like. It should be appreciated, however, that the bushing adapter 170 is typically provided as a separate component and is attached to the remaining part of the bushing 100 on the basis of one or more of the above-specified connection techniques.

The bushing adapter 170, as shown in FIG. 1, comprises an operable fastening member 173 that, in illustrative embodiments, is rotatable with respect to the insert 171, for instance by being provided as a separate member that is partially inserted into a bore 172 formed in the insert 171. In other embodiments, the fastening member 173 may be operated on by shifting or moving the fastening member 173 in any other way so as to establish and hold mechanical contact to a counterpart component, such as an external conductor, a housing, and the like.

The fastening member 173 has an operating portion 173A, which may be accessed by any appropriate tool so as to be rotated relatively to the insert 171.

That is, the fastening member 173 comprises the operating portion 173A at a bushing internal end thereof so as to be positioned within the bushing 100 in the attached state. Moreover, the fastening member 173 comprises a fastening portion 173B positioned outside the bore 172 at a bushing external end of the bushing adapter 170, thereby enabling engagement with a corresponding counterpart opening of the external conductor 152. For example, the fastening member 173 may be provided in the form of a screw or bolt having a threaded portion so as to engage with the counterpart opening of the conductor 152 and provide for a reliable mechanical connection therewith. In other embodiments, the fastening portion 173B may comprise in addition or alternatively to a threaded area any appropriate locking member so as to be guided by the counterpart opening of the conductor 152 into a counterpart locking member for entering a locked state upon rotating the operating portion 173A relatively to the insert 171 and the external conductor 152. It should be appreciated that the corresponding locking member may be represented by the fastening portion 173B having an appropriate configuration, for instance a key-type configuration, which cooperates with a respective lock-type opening as a counterpart locking member of the conductor 152.

In an embodiment, the fastening member 173 may "snap" into a locked position upon rotating the fastening member 173 by a certain angle of rotation, for instance by 90° or greater, thereby reducing the time required for actually securing the fastening member 173 to the respective housing internal conductor or any associated contact assembly. To this end, the fastening member 173 and the counterpart member have respective complementary shapes and dimensions so as to enable mechanical contact and a guiding function, thereby finally providing for a locked state upon completing a specific rotation, which may substantially not unintentionally be released.

In an embodiment, the fastening member 173 may be provided in the form of a screw or bolt having a standard size, for instance M8-M16 in applications, in which the transfer of relatively high electrical power is required. In other embodiments, the fastening member 173 may be attached and locked to the counterpart locking member by any other mechanism, which may not require a relative rotation between the fastening member 173 and the counterpart member. To this end, the fastening member 173 may be operated on by a tool in a substantially linear manner, thereby, for instance, press-fitting the fastening portion to the counterpart locking member.

In the embodiment shown in FIG. 1, the electrical connection between the conductor 152 and the bushing 100 is established on the basis of the insert 171, for instance by using the end faces 171F as contact surfaces. In the shown embodiment, the insert 171 is formed of a highly conductive material, such as copper, aluminum, and the like. In an embodiment, the fastening member 173 may be formed of any appropriate material, such as a non-conductive material, steel, such as stainless steel, and the like in order to provide for superior mechanical robustness, wherein, for instance, the operating portion 173A, for example provided in the form of a screw head, may have a significantly increased mechanical strength compared to, for instance, a copper bolt. Furthermore, the fastening portion 173B may thus provide a highly durable and robust mechanical connection with the corresponding counterpart opening in the conductor 152, irrespective of whether a threaded connection or a connection on the basis of one or more locking members is established.

A washer 175, as shown in the embodiment of FIG. 1, may be positioned between the insert 171 and the operating portion 173A, enabling the adjustment of any appropriate distance of these components and/or providing for superior force distribution from the operating portion 173A into the insert 171. To this end, the washer 175 may be provided in the form of any appropriate material, which may or may not have electric conductivity, since basically the fastening member 173 may not take part in the overall conduction of electricity in the bushing 100. In other embodiments, in addition to or instead of these functions, the washer 175 may provide for a locking function in order to substantially eliminate unintended rotation of the fastening member 173 with respect to the insert 171 after having established the mechanical connection with the external conductor 152.

After providing the individual components of the bushing adapter 170 and after the assembling these components, i.e. after the insertion of the optional washer 175 and the fastening member 173 into the bore 172, the bushing adapter 170 may be attached to the remaining components of the bushing 100 on the basis of any appropriate connection techniques, as described above. Thereafter, an appropriate tool, for example an Allen Key, may be inserted into the inner bore 125 of the conductor 120 so as to finally reach the operating portion 173A. After engagement of the respective tool with the operating portion 173A and after positioning the conductor 152 relatively to the bushing 100, the mechanical connection may be established by rotating the operating portion 173A and thus the fastening member 173, thereby finally obtaining a locked state, however, without requiring a rotation of the bushing 100 as a whole.

Consequently, the bushing 100 and in particular its insulating body 110 may be configured so as to allow the mounting of the bushing 100 to any appropriate component, such as a housing, without having to take into consideration a relative rotation of the bushing 100 with respect to the housing or component. In particular, the modular design of the bushing 100 in the form of the bushing adapter 170 including the rotatable fastening member 173 allows permanent installation of the bushing 100 while still providing for the possibility of installing and dissembling the mechanical connection between the conductor 152 and the bushing 100. When dissembling the mechanical connection between the bushing conductor 120 and the external conductor is required, there is no need to dissemble the entire bushing 100 from a corresponding housing or other component and therefore the mounted and aligned state of the bushing 100 with respect to the housing or other component may be maintained throughout the entire process. Additionally, at the side of the external conductor 152, a minimum of installation space is required.

In another embodiment of a bushing 200 shown in FIGS. 2A-2C described in greater detail below, the insert of the corresponding bushing may not represent an electrically active part of the bushing conductor.

Figure 2A:
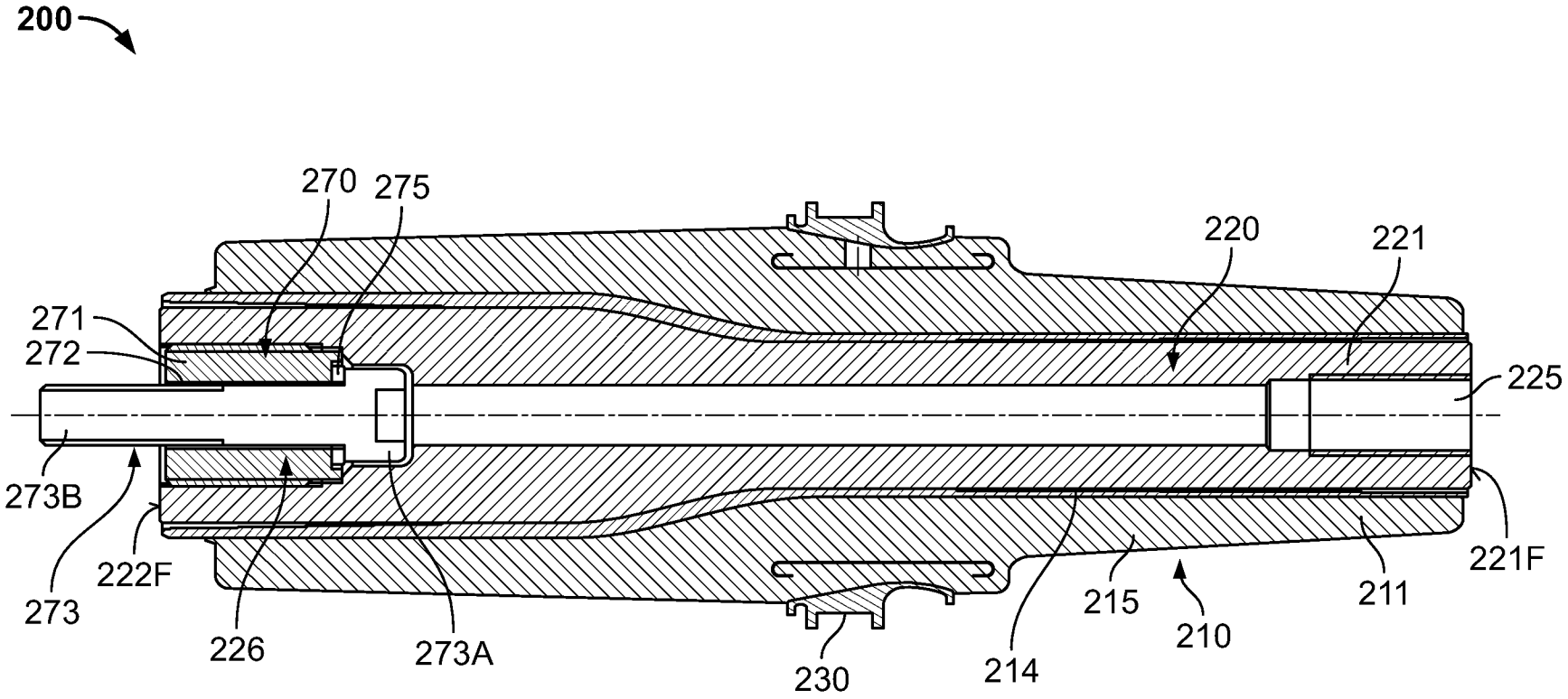
FIG. 2A is a sectional view of a bushing according to another embodiment.

The bushing 200 according to another embodiment, as shown in FIG. 2A, comprises a bushing adapter 270, a bushing conductor 220, and an insulating body 210. The bushing conductor 220 has a connecting portion 221 including an end face 221F, which represents a contact surface for connecting to an external cable or a contact assembly associated therewith. Moreover, contrary to the embodiment shown in FIG. 1, the conductor 220 has at its opposite end an end surface 222F for connecting to an external conductor, such as the conductor 152 as shown in FIG. 1. It should be appreciated that the cross sectional area of the end face 222F is appropriately dimensioned so as to provide for the required current drive capability, thereby avoiding the necessity of using one or more components of the bushing adapter 270 as a conducting element.

In the embodiment shown in FIG. 2A, the insulating body 210 may have a specific design, in which a highly insulating material, such as an epoxy resin 215 may provide for the insulating characteristics in a radial direction, while a shielding sheath 214 may additionally be provided as an inner surface of the insulating body 210, thereby imparting superior electrical and interface characteristics to the insulating body 210. For example, the shielding sheath 214 may be formed of a metal, such as aluminum, which may have a similar coefficient of thermal expansion compared to an epoxy resin, while on the other hand, a superior mechanical contact may be established to the bushing conductor 220, which is typically formed of copper, copper alloys, and the like. In other embodiments, the shielding sheath 214 may be provided as a coating having a thickness of less than 0.1 mm and made of any conductive material. Furthermore, a mounting structure 230 as shown in FIG. 2A may be provided at any appropriate position along the insulating body 210, wherein, as previously discussed, the mounting structure 230 may have any appropriate configuration for connecting to a further component or housing without having to take into consideration a rotation of the bushing 200 as a whole when mechanically connecting the external conductor to the bushing adapter 270. Similarly, internal reinforcement components of the insulating body 210, such as a ridge, and the like, may be provided without restriction that is conventionally caused by the requirement of a rotation of the entire bushing 200 upon installing the mechanical connections.

The bushing adapter 270, as shown in FIG. 2A, comprises an insert 271, which may have a reduced size so as to fit into a corresponding recess 226 formed in the conductor 220. It should be appreciated that generally the insert 271 may have reduced dimensions with respect to the insert 171 of the bushing 100 of FIG. 1. The insert 271 may be made of any appropriate material, such as stainless steel, a non-conductive material, or any combination thereof in order to obtain the desired mechanical characteristics. The insert 271 may be attached to the conductor 220 within the recess 226 by any appropriate connection technique, such as by a threaded connection, press fitting, pinning, gluing, welding, soldering, and the like. Non-conductive materials may be used for the insert 271 in terms of superior mechanical robustness and/or temperature behavior, for instance in view of coefficient of thermal expansion, and the like, in order to meet the specific requirements for the use case of interest. Since the overall conductivity of the bushing conductor 220 may suffice for transferring the required electrical power, a corresponding conductivity of the insert 271 may be significantly lower compared to the bushing conductor 220 or the material thereof may be basically non-conductive. Due to the possibility of specifically selecting the material characteristics of the insert 271 it may be formed with reduced size, thereby leaving sufficient highly conductive material of the bushing conductor 220 that is available for electrical connection to the external conductor.

The bushing adapter 270, as shown in FIG. 2A, further comprises a rotatable fastening member 273 that extends through a bore 272 and comprises an operating portion 273A and a fastening portion 273B. Similarly, as is also described above with reference to the bushing adapter 170, the fastening member 273 may thus be movable and in particular rotatable with respect to the insert 271 and may be formed of any appropriate material, such as stainless steel, any non-conductive material, or any combination thereof. Furthermore, an optional washer 275 may be provided so as to adjust the distance and/or force distribution from the member 273 into the insert 271 and/or providing a locking function so as to hinder unintended rotation of the member 273 after having been connected to the external conductor.

In the embodiment shown in FIG. 2A, the bushing adapter 270 may be formed as a separate component including the rotatable member 273 and may be attached to the remaining part of the bushing 200 at the installation location or may be provided as a pre-assembled component by appropriately attaching the adapter 272 to the remaining components of the bushing 200 at any appropriate time prior to actually installing the bushing 200. The bushing 200 may then be aligned with respect to an external conductor, possibly after having been mounted to a respective component, such as a housing, and thereafter an appropriate tool may be inserted into the inner bore 225 so as to finally engage with the operating portion 273A. Upon rotating the member 273 it may engage with a corresponding counterpart opening so as to establish a robust mechanical connection. It should be appreciated that with respect to the type of mechanical connection, for instance based on a threaded portion, one or more locking members, and the like, in cooperation with a corresponding counterpart configuration at the side of the external conductor, it is also be referred to the embodiments described with reference to FIG. 1.

Figure 2B:
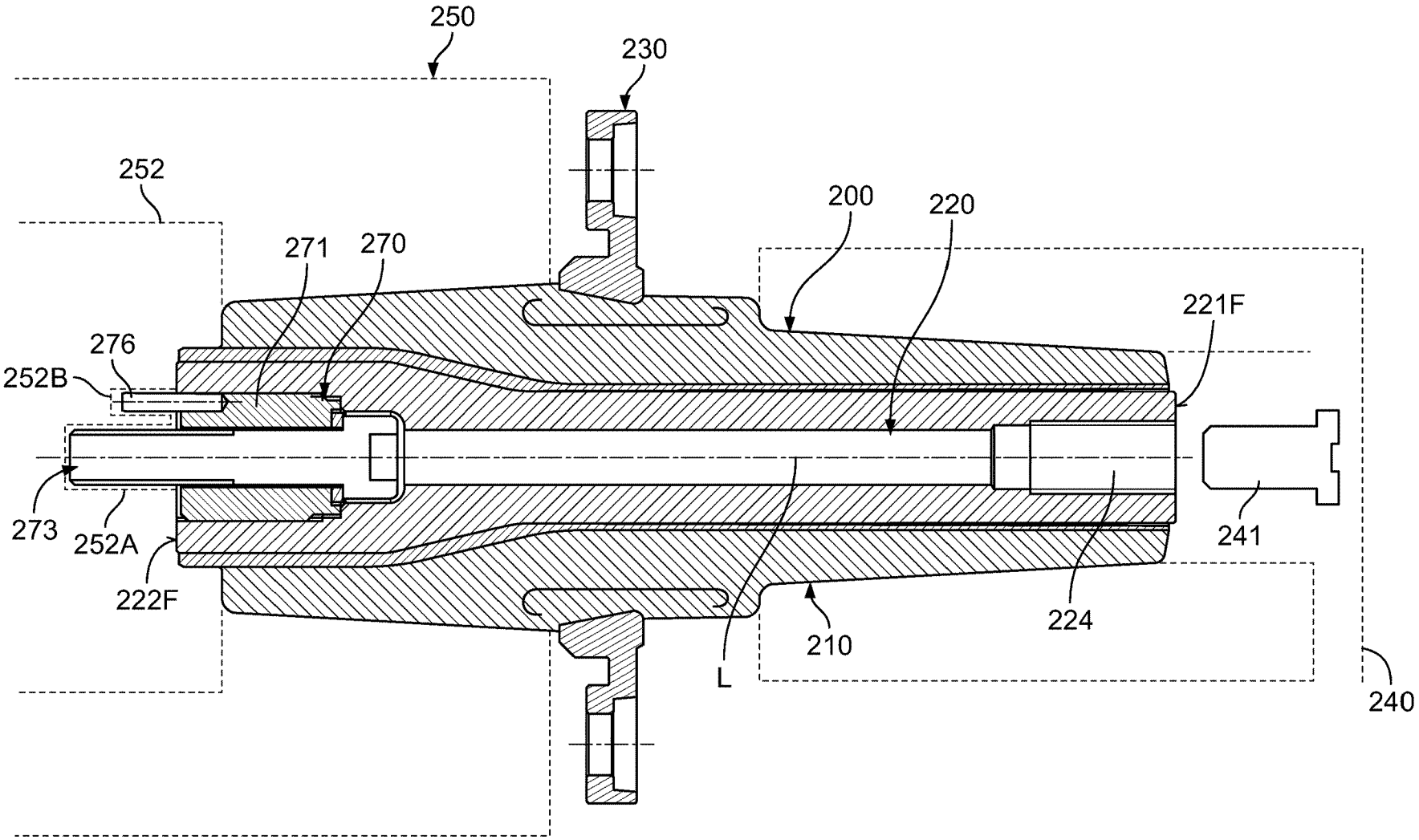
FIG. 2B is a sectional view of the bushing of FIG. 2A with a housing and an external cable.

As shown in FIG. 2B, the bushing 200 may be mounted to a housing 250, which may have any appropriate size and shape as determined by the specific application under consideration. For example, the housing 250 may typically represent a metal housing that accommodates specific electrical components, for instance a switch assembly, such as a magnetic contactor, a transformer or at least a portion thereof, an electric machine or a contact portion thereof, and the like. The bushing 200 protrudes into the interior of the housing 250 and may connect to any appropriate housing internal conductor 252, which may also be referred to as an external conductor, and which may represent any appropriately dimensioned and shaped conductor for connecting to a further component within or outside the housing 250. Similarly, the bushing 200 may connect to a respective terminal portion or any other contact assembly provided in combination with an external cable 240. To this end, the bushing conductor 220 may be connected with its connecting portion 221 to the terminal portion or contact assembly of the cable 240 so as to be in mechanical and thus electrical contact therewith. In particular, the end face 221F of the connecting portion 221 is in contact with a respective part of the cable 240 and may be mechanically fixed thereto by any appropriate fastening device, such as a screw or bolt 241, which may be threaded into a corresponding bore 224 that is formed in the bushing conductor 220. As previously discussed, the fastening device 241 and the threaded bore 224 may be configured so as to comply with specific standards in order to allow the connection of any terminal portion or contact assembly complying with the corresponding standards. Consequently, when the external cable 240 or a corresponding terminal portion or contact assembly thereof is mechanically connected to the connecting portion 221, the electrical connection is basically established by the end face 221F and a corresponding surface portion of the cable 240, possibly in combination with the fastening device 241, while any outer surface areas of the connection portion 221 may substantially not contribute to the electrical and mechanical connection with the cable 240.

As shown in FIG. 2B, the bushing conductor 220 may electrically connect with its end face 222F to the housing internal conductor 252, whereas a respective mechanical connection is established by the bushing adapter 270. That is, the rotatable fastening member 273 may engage with a corresponding counterpart opening 252A formed in the conductor 252, wherein, as previously discussed, the mechanical connection may be established on the basis of a threaded connection, a key-lock-type connection, and the like. Furthermore, in some embodiments, a locking element 276 may be provided in combination with the insert 271 so as to engage with a counterpart locking element 252B of the conductor 252, thereby substantially eliminating the possibility of unintended rotation of the insert 271 with respect to the conductor 252. In an embodiment, the locking element 276 is a lock pin and the counterpart locking element 252B is an opening or cavity.

Upon installing the bushing 200 on the housing 250, the mounting structure 230 may be used for mechanically connecting the bushing 200 to the housing 250, thereby positioning the bushing 200 in an appropriate position for establishing the mechanical connection between the bushing adapter 270 and the housing internal conductor 252. It should be appreciated that mounting the bushing 200 to the housing 250 may be established so as to obtain a desired relative orientation of these two components without requiring any readjustment after having connected the conductor 252 to the bushing adapter 270. Thereafter, the conductor 252 may be positioned in an appropriate manner with respect to the bushing 200 and an appropriate tool, such as an Allen Key, and the like, may be inserted into the inner bore 225 so as to finally engage with the member 273, as is already discussed above. Consequently, by operating the member 273, the desired mechanical connection between the conductor 252 and the bushing 200 may be established. It should be appreciated that due to the presence of the locking element 276 and its counterpart locking element 252B, unintended relative rotation of the insert 271 with respect to the conductor 252 may reliably be avoided. Next, the external cable 240 may be connected to the conductor 220 after removal of the corresponding tool. To this end, well-established standardized connection means, such as the screw or bolt 241 in combination with a threading formed within the recess 224 may be employed. As a consequence, a mechanically robust connection along a length direction L of the bushing 200 may be established with the conductor 252 on the basis of the rotatable fastening member 273.

In other embodiments, in addition or alternatively to the central fastening member 273, the insert 271 may comprise two or more respective bores, through which corresponding fastening members may extend into the housing 250. Similarly, a respective plurality of bores 225 may be provided in the conductor 220 so as to allow accessing the respective fastening members by a corresponding tool, as also discussed above. In this case, the conductor 252 or its contact assembly may have to be appropriately designed so as to correspond to at least one of the plurality of fastening members 273, thereby establishing a highly robust mechanical connection with one or more of the plural fastening members.

Figure 2C:
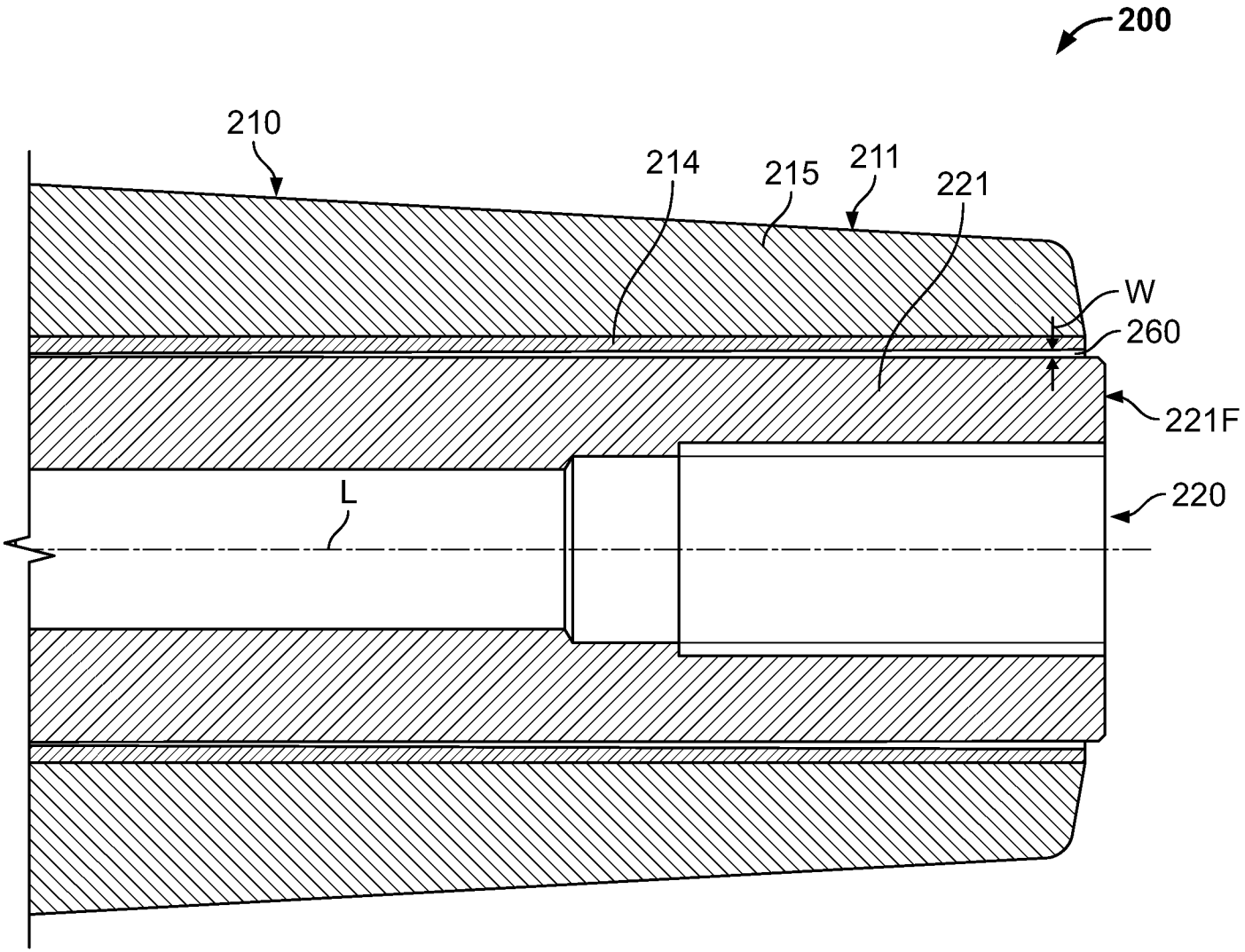
FIG. 2C is a sectional view of an end portion of the bushing of FIG. 2A.

At an end portion of the bushing 200, shown in FIG. 2C, superior mechanical contact is not only obtained at the side of the external conductor on the basis of the bushing adapter 270 but also at the side of the contact assembly connected to the external cable 240. To this end, the connecting portion 221 of the bushing conductor 220 may be configured so as to be elastically displaceable or deformable with respect to a respective body end portion 211 of the insulating body 210, shown in FIG. 2C.

As explained above, in many sophisticated applications, significant mechanical stress may not only be introduced into the bushing 200 at the side of the conductor 252 but also at the opposite side, wherein in addition to the overall mechanical stress in particular significant radial forces may be introduced, for instance induced by oscillations and vibrations in combination with the moderately heavy weight of the corresponding external cable connected to the connecting portion 221. In the embodiment shown in FIG. 2C, a significant mechanical decoupling between the connecting portion 221 of the conductor 220 and the corresponding body end portion 211 of the insulating body 210 may be achieved by the elastic displacement ability of the connecting portion 221.

In the embodiment shown in FIG. 2C, a clearance 260 is provided between the connecting portion 221 and the body end portion 211. For example, a maximum width W, for instance taken at or in the vicinity of the end face 221F may range from 0.1-1.0 mm, which may suffice for accommodating a corresponding vibration amplitude or radial force acting on the connecting portion 221. On the other hand, the remaining insulating body 210 may be in tight mechanical contact, for instance based on the superior interface characteristics provided by the shielding sheath 214, with the conductor 220, thereby providing an overall mechanically stiff and robust configuration except for the clearance 260, which may have a length of 15-30 mm.

In an embodiment, the clearance 260 between these two components is selected such that a maximum displacement of the connecting portion 221 that is expected to occur in the specific application may be accommodated by the clearance 260. For example, in specific applications requiring the transfer of high power of several tens of kilowatts and higher the weight of the external cable 240 and/or the corresponding contact assembly thereof may result in the introduction of radial forces that cause a displacement of the connecting portion 221 of up to 0.3 to 0.4 mm. By providing the clearance 260 with a width in accordance with the above-identified range, a significant mechanical contact between the displaced connecting portion 221 and the moderately stiff insulating body 210 may be avoided.

In other embodiments, the elastic deformation capability of a connecting portion of the bushing conductor 220 may also be implemented at the opposite side of the bushing 200. For instance, a respective clearance, as schematically shown in FIG. 2A, may be provided, thereby obtaining a similar configuration as described above in the context of the clearance 260 and the connecting portion 221.

The embodiments discussed above in the context of FIGS. 1-2C refer to a modular system of the bushing 100, 200 including the bushing adapter 170, 270. In other embodiments, the operable fastening member 173, 273 may be provided as a permanent component within the bushing 100, 200, as long as the fastening member 173, 273 is accessible through the bushing conductor, as is similarly described above for the modular versions of the bushing 100, 200. For instance, the fastening member 173, 273 may be inserted into the bushing upon forming the bushing conductor and assembling these components.

What is claimed is:

1. A bushing adapter, comprising:

an electrically conductive insert having a bore extending through the insert along a length direction of the insert, the insert having an opening for receiving a portion of a bushing conductor of the bushing and configured to be attached and electrically connected to the bushing conductor; and a fastening member extending through the bore and having an operating portion positioned outside of the bore at a bushing internal end of the fastening member and a fastening portion positioned outside of the bore at a bushing external end of the fastening member.

2. The bushing adapter of claim 1, wherein the fastening portion has a threaded portion configured to engage with a threaded counterpart.

3. The bushing adapter of claim 1, wherein the fastening portion has a locking member configured to engage with a counterpart locking member.

4. The bushing adapter of claim 1, wherein the insert has a first contact surface for electrically connecting to the bushing conductor and a second contact surface having an end face for electrically connecting to an external conductor.

5. The bushing adapter of claim 1, wherein the insert is formed from a non-conductive material and/or a steel material.

6. The bushing adapter of claim 1, wherein the insert is fitted over and encloses a recess of the bushing conductor.

7. The bushing adapter of claim 1, wherein the opening of the insert is coaxial with the bore and the operating portion of the fastening member is arranged within the opening.

8. The bushing adapter of claim 1, wherein the insert is arranged at least partially within an insulating body.

9. The bushing adapter of claim 1, further comprising a washer separating the operating portion from the insert.

10. The bushing adapter of claim 9, wherein the washer provides a locking function.

11. The bushing adapter of claim 1, further comprising a locking element distinct from the fastening member and connected to the insert and configured to engage with a counterpart locking element to prevent unintended rotation of the insert.

12. The bushing adapter of claim 11, wherein the locking element comprises a locking pin extending from the insert and adapted to engage with an opening defining the counterpart locking element.

13. A bushing, comprising:

a bushing conductor having an inner bore;

an insulating body enclosing at least a portion of the bushing conductor;

a bushing adapter arranged at least partially within the insulating body and having an electrically conductive insert with a bore extending through the insert along a length direction, the insert defining an opening receiving a portion of the bushing conductor and configured to be attached and electrically connected to the bushing conductor; and a fastening member included in the bushing adapter and having an operating portion positioned at a bushing internal end of the fastening member and a fastening portion positioned at a bushing external end of the fastening member, the operating portion is accessible through the inner bore.

14. The bushing of claim 13, wherein the inner bore receives a tool for engaging and operating the operating portion of the fastening member.

15. The bushing of claim 13, wherein the bushing conductor has a connecting portion with an end face for connecting to an external cable.

16. The bushing of claim 15, wherein the connecting portion is elastically deformable with respect to a body end portion of the insulating body.

17. The bushing of claim 16, wherein a clearance is provided between the connecting portion and the body end portion.

18. A method of establishing an electrical connection with a bushing, comprising:

enclosing an end portion of a bushing conductor of the bushing with an electrically conductive insert, the insert defining an opening receiving the end portion of the bushing conductor and configured to be mechanically attached and electrically connected to the bushing conductor;

providing a fastening member within the bushing at a first end of the bushing and extending through a bore defined through the insert;

accessing the fastening member with a tool through an inner bore formed inside the bushing conductor of the bushing;

mechanically connecting the bushing conductor to an external conductor by operating the fastening member with the tool; and connecting the bushing conductor at a second end of the bushing to a contact assembly of a cable.

19. The method of claim 18, wherein the connecting step is performed after the mechanically connecting step.

20. The method of claim 18, further comprising the step of mechanically engaging a locking pin of the insert into a corresponding opening associated with the external conductor for preventing unintended rotation of the insert relative to the external conductor.

* * * * *